United States Patent [19]

Mittelmann et al.

[11] 4,428,491

[45] Jan. 31, 1984

[54] FREIGHT CONTAINER, IN PARTICULAR FOR AIR TRANSPORT

[75] Inventors: Gerhard Mittelmann, Oehningen; Klaus P. Brodbeck, Singen, both of Fed. Rep. of Germany

[73] Assignee: Swiss Aluminium Ltd., Chippis, Switzerland

[21] Appl. No.: 272,718

[22] Filed: Jun. 11, 1981

[30] Foreign Application Priority Data

Jun. 28, 1980 [DE] Fed. Rep. of Germany ..... 3024410

[51] Int. Cl.[3] ..... B65D 88/14

[52] U.S. Cl. ..... 220/1.5; 160/120; 206/509; 220/23.6; 220/84; 220/71; 220/350

[58] Field of Search ..... 220/84, 23.6, 1.5, 4 C, 220/71, 350; 410/77, 78, 79, 84, 76, 99, 96, 111, 101, 102, 112, 113, 114; 206/386, 597, 600, 509; 217/43 A; 150/0.5; 160/118, 120, 168 R

[56] References Cited

U.S. PATENT DOCUMENTS

| | | | |
|---|---|---|---|
| 1,997,846 | 4/1935 | Armstrong | 160/98 |
| 2,548,560 | 4/1951 | Schembra | 160/98 |
| 2,739,730 | 3/1956 | Jonas | 220/350 |
| 2,998,156 | 8/1961 | Stricker, Jr. | 220/1.5 |
| 3,015,407 | 1/1962 | Fesmire et al. | 206/509 |
| 3,078,917 | 2/1963 | Recchione | 160/120 |
| 3,210,038 | 10/1965 | Bader et al. | 410/77 |
| 3,546,753 | 12/1970 | Lafont | 24/81 X |
| 3,570,050 | 5/1971 | Weingarten et al. | 150/0.5 |
| 3,672,529 | 6/1972 | Feddersen et al. | 49/197 |
| 3,749,273 | 7/1973 | Wreghitt | 220/23.6 |
| 3,860,236 | 1/1975 | Buchanan | 49/197 |
| 3,907,148 | 9/1975 | Meller et al. | 220/4 R |
| 3,972,437 | 8/1976 | Lovich et al. | 220/1.5 |
| 3,984,117 | 10/1976 | Bates et al. | 410/77 |
| 4,144,821 | 3/1979 | Lang | 410/79 |
| 4,236,853 | 12/1980 | Niggemeier et al. | 410/76 |
| 4,249,852 | 2/1981 | Alstad | 220/334 |
| 4,277,212 | 7/1981 | Rosaia | 410/84 |

*Primary Examiner*—Allan N. Shoop
*Assistant Examiner*—Robert Petrik
*Attorney, Agent, or Firm*—Bachman and LaPointe

[57] ABSTRACT

The invention relates to freight containers, in particular containers for air transport with a supporting frame which is made of profiled sections or the like, the long sides of which frame comprise polygonal frames which have roof sections and reinforcing vertical struts, and are joined by transverse sections. In spite of being made according to standard, it should be possible to stack these readily on top of one another and secure them to each other. They should also feature facilities which allow access at all times to the freight to be transported. The supporting frame (7) of such an improved container (5) features, between the roof sections (18), clamping elements (21,24) to secure neighboring, stacked containers in place; also for stacking purposes, the roof sections are reinforced and the vertical struts (16) are positioned at the places of greatest load. If desired, the reinforced roof sections house facilities (40,41,42) to guide closure means (35) for stacked freight containers. As such, the vertical supports in symmetrically designed containers should be arranged at a distance (a) from each other on a long side (11,12), the distance (a) being equal to approximately twice the distance (b) between a vertical strut and an outermost corner post (19) of the container on the same long side.

14 Claims, 4 Drawing Figures

FREIGHT CONTAINER, IN PARTICULAR FOR AIR TRANSPORT

BACKGROUND OF THE INVENTION

The invention relates to a freight container, in particular a container for air transport, having a supporting frame which is made of profiled sections or the like and long sides in the form of polygonal frames resting on a base frame. The polygonal frames comprise vertical reinforcing struts and roof sections and are joined together by transverse sections.

Such freight containers have been used in aircraft for a long time now. Up to now, in aircraft with the fuselage divided into an upper deck and lower deck, the latter is loaded with containers while the former is reserved for passengers. These decks differ somewhat, especially in height. The cross section of the upper deck is usually a semi-circle made up of the floor of the deck and part of the fuselage body. The lower deck is delimited by two parallel, facing surfaces viz., the separation of the decks and a floor built into the fuselage; the sidewalls are likewise formed by the fuselage. Containers have been specially designed to take account of the shape of the outer walls in the lower deck.

There is now an increasing trend to make more economic use of the available space in flights with fewer passengers, e.g., night flights, in that the upper deck is also loaded with freight. However, as the supporting frame of the so-called lower deck container is too weak to allow stacking, this calls for the development of special containers. Also, with the existing containers too much space is lost between them, which represents uneconomic use of the available space.

The lower deck containers have to be secured individually to the floor. However, no provision has been made to allow them to be secured to each other, especially when stacked.

It has also been found to be a disadvantage that when the containers used up to now have been loaded into the fuselage, they are no longer accessible.

It is therefore an object of the invention to develop containers which in spite of being made according to standard can be readily stacked, secured to each other and also when stacked feature facilities which allow access at all times to the freight to be transported. It is a further object of the invention that the container should, of necessity, be of low weight and should be producible both at low cost and in large quantities.

SUMMARY OF THE INVENTION

These objects are achieved by way of the invention in that the supporting frame features clamping elements between the roof sections to hold neighboring, stacked containers in place; also, for stacking purposes the roof sections are reinforced and the vertical struts are positioned at the places of greatest load. If desired, the reinforcing roof sections house facilities to guide closure means for stacked containers. This arrangement makes it possible to load containers on top of each other on one deck.

BRIEF DESCRIPTION OF THE DRAWINGS

Further advantages, features and details of the invention are revealed in the following description of preferred exemplified embodiments, and with the aid of the drawings viz., FIG. 1—A schematic of the fuselage of an aircraft loaded with freight containers.

DETAILED DESCRIPTION

In accordance with the present invention, if the containers are stacked symmetrically, it has been found useful to position the vertical supports on the same long side at a distance apart which corresponds to double the distance between one of the vertical struts and an outermost corner post of the container on the same long side.

The vertical struts provided in the sides of the container are therefore positioned such that they form a structure like a supporting wall when the containers are stacked. If two vertical struts are employed as supporting elements in each sidewall, then the distance between them should correspond to approximately twice the distance between one vertical strut and an outermost corner post of the container on the same long side. If two such shaped containers are arranged end-to-end i.e. with their transverse sides viz., their corner posts next to each other, and a third container is set on top of these containers, then the container on top is supported equally by the two containers below it. At the same time the axes of the vertical struts of the lower and upper containers coincide. This provides an optimum distribution of load in the containers stacked together.

The already described distance between the pair of vertical struts in a sidewall is, usefully, a function of the number containers stacked in rows and on top of each other, the height of the corner post and the width of an aircraft floor. The height of the corner post is particularly important in determining the amount of free, unused space in a loaded cargo space. The free space increases along with the height of the corner post; making this too small then has a negative effect on the loading of the containers with freight.

The elements which prevent the containers from being displaced also when stacked are, according to the invention, fixed to a flat section which joins the roof sections and which, preferably, at the same time serves as a support for a transverse section in the base frame of the container loaded on top of the other containers; for this reason they should be situated in the axis of symmetry of the container.

Figure 3:
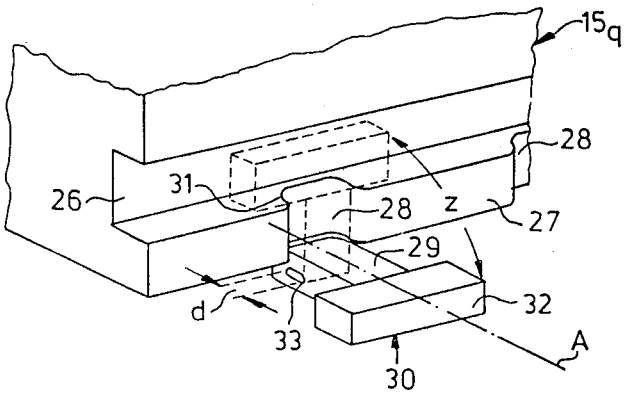
FIG. 3—A perspective view of an enlarged and sectioned part of the container shown in FIG. 1.

It is within the scope of the invention as shown in FIG. 3 that, at least in a transverse section in the base frame of the container, a groove into which the securing element engages is provided parallel to the floor; in this case the securing element engages on a base section formed by the groove. This base section preferably features recesses which at the same time create shoulder-like ledges; the shaft of a hammer-shaped securing element can be lowered into the recess in such a way that the hammer-shaped head engages on the shoulder-like ledges. The last mentioned version in particular has the advantage that the container is prevented from slipping in all directions. This is an essential requirement if containers are to be stacked for transport by air.

According to the invention the shaft of the hammer-shaped securing element is hinged on a pin which is introduced in a hole in the shaft running transverse to the axis of the shaft. This hole is preferably elongated parallel to the shaft axis and the securing element can be moved within its range against the force of a means of stored energy. This design takes into account the occasionally different height of the base section and makes it easier to engage the hammer in the groove. The means of stored energy can also be arranged on the securing element itself and press the hammer head in the locking position on the base section.

As a further measure for making the containers stackable, strengthening of the roof sections is provided for by the use of, if desired, extruded hollow sections.

According to the invention these hollow sections can, if desired, feature facing slits to accommodate a means of closure for the container, preferably a sliding door the long side edges of which penetrate the slits. This has the advantage that it always allows access to the interior of stacked containers. Between the aircraft wall and the sliding door there is sufficient space for a passageway to allow the desired container to be located. The sliding door is pushed under the section which supports the container above it without interfering with the stability of the stack or individual container.

For this reason it has been found advantageous to provide a slit not only in the roof sections but also in the facing corner posts, and the struts joining the corner posts and the roof sections so that the sliding door can be pulled down to the cross section on the base frame. This improves the access to the freight further without affecting the ability to stack the containers.

The use of reinforcing hollow sections for roof sections, transverse struts and corner posts has the further advantage that, inside them, pairs of rollers with rolling surfaces facing can be housed, between which the edge regions of the sliding door can be guided.

A drum on which the sliding door can be rolled up is provided between two facing vertical struts; this drum can contain a means of storing energy against the return force of which the sliding door is either opened or closed.

This container has, besides the above mentioned advantages, also the advantage that it can be made according to standard and in large quantities. The weight, compared with known containers, is hardly increased especially if a textile covering is chosen for the sides instead of the usual metal covering used up to now.

Referring to the drawings, the fuselage 1 of an aircraft comprises an upper deck 2 and a lower deck 3 which are separated by a floor 4.

Figure 1:
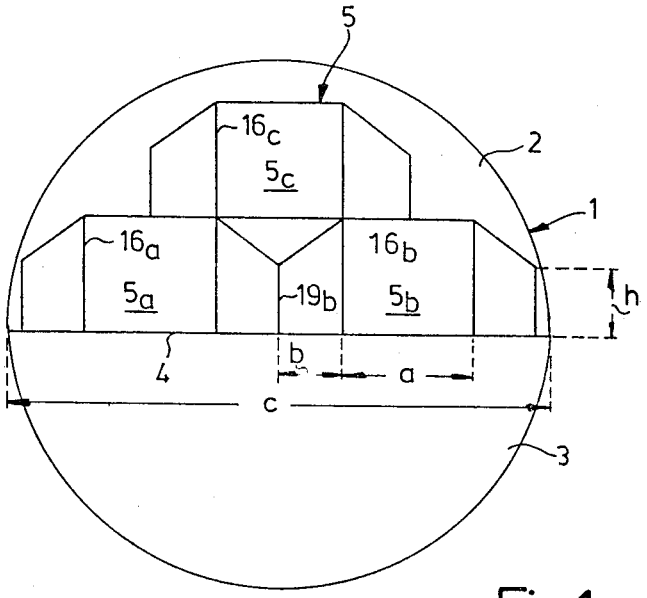

Loaded on this floor 4 in the upper deck 2 are, for example in FIG. 1, three freight containers 5.

A freight container 5 features a light metal frame 7 which comprises basically two polygonal frames 13 which form the long sides 11,12 of the container 5 which are joined by transverse sections 14. These polygonal frames 13 are mounted on a base frame 15 made up of longitudinal and transverse sections **15*l* and 15*q* respectively. In addition, the long sides 11,12 are reinforced with struts 17 running parallel to the base 9 and struts 16 running perpendicular to the base 9**.

These struts 16 are positioned between roof sections 18 and base frame 15 in such a way that they can withstand considerable loading. FIG. 1 shows schematically that the vertical struts **16*a*, 16*b*, 16*c* of a plurality of stackable containers 5*a*, 5*b*, 5*c*** are arranged such that, when the containers are stacked, they lie preferably exactly one over the other so that they fulfill their load-bearing function in an optimum manner.

From the point of view of design this means that the distance a between a pair of vertical struts 16 on a long side 11 or 12 of a container 5 is approximately equal to twice the distance b which is the distance of the vertical strut 16 from an outermost corner post 19 of the polygonal frame 13. The dimensions a and b depend basically on the width c of the floor 4, the number of containers 5 to be loaded next to or on top of each other, and on the height h of the post 19.

Transverse sections **15*q* in the base frame 15 feature a groove 20, or alternatively a ridge, which projects beyond the length $a+2\times b$ of the long side, in which clamping elements 21 on the floor 4 engage securing the container 5** in place.

Figure 2:
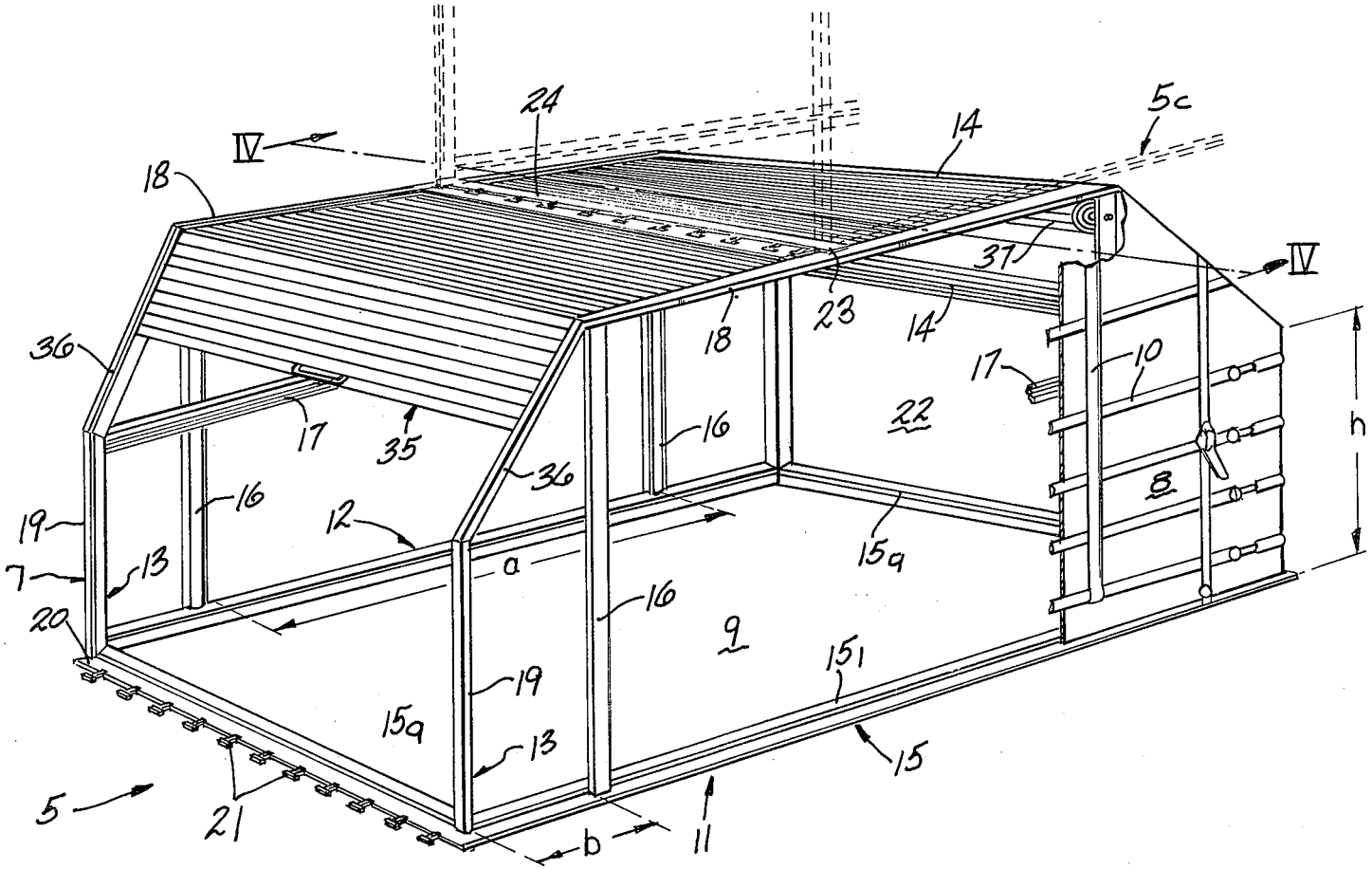
FIG. 2—A perspective view of an aircraft freight container.

Running across the roof sections 18 is a flat section 23 which also features clamping elements 24. If the containers 5 are stacked up (FIG. 1), then the transverse section **15*q* in the base frame 15 of container 5*c* (as indicated by broken lines in FIG. 2) is laid on this flat section 23 and can be held in place by the clamping elements 24**.

The clamping elements 21 and 24 for securing the container 5 in place are illustrated in FIG. 3. In this case a groove 26 which is parallel to the floor is provided in the transverse section **15*q* of the base frame 15, so that a base section 27** is formed.

Section 27 features recesses 28 into which the shaft 29 of a hammer-shaped locking element 30 can be inserted. A hammer-shaped head 30 joined to the shaft 29 rests, in the clamping position indicated by broken lines, on shoulder-like ledges 31 formed by the recess 28.

The clamping element 30 is, as a rule, hinged onto the floor 4 or the section 23 by means of a pin which is not shown here but passes through a hole 33 in order to make it possible to tilt the element 30 in direction z. The hole 33 is preferably elongated in the direction parallel to the axis A of the shaft; the pin is likewise moveable in this hole 33 parallel to the axis of the shaft 29. The clamping element 30 can be moved against the force of a means of storing energy, not shown here, the dimension d of the elongated hole 33 in the vertical position i.e. on engaging in recess 26.

A trough which is not shown here but in which the end of the shaft remote from the hammer head 32 can move is, of necessity, provided in the floor 4 or section 23.

Stretching over the light metal frame 7 on the side walls 11 and 12 and a backwall 22 is for example a flexible covering 8 which is held in place by a network of belts 10 running parallel and perpendicular to the container base 9.

A sliding door 35 is provided between the two roof sections 18; this can be pulled down in the corner posts 19 and in the struts 36 connecting the corner posts 19 to the roof sections 18, right down to the transverse section **15*q* of the base frame 15**.

The sliding door 35 can be rolled up over a drum 37 which can rotate about an axis M (FIG. 4) between two opposite lying, vertical struts 16 near the back wall 22.

Figure 4:
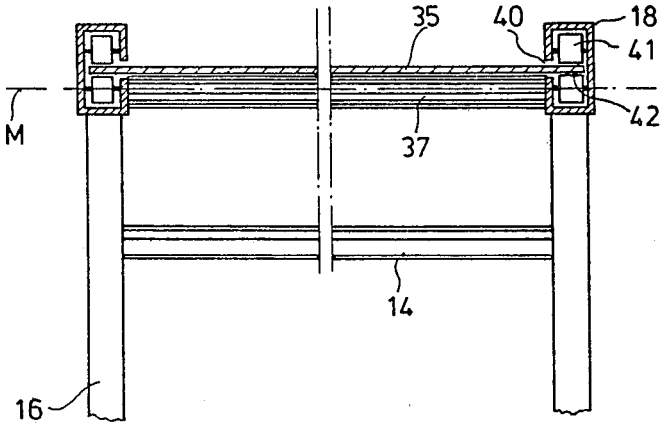
FIG. 4—A part of the section along line IV—IV in FIG. 2.

As shown in FIG. 4 the roof sections 18 are hollow sections each featuring a slit 40. Inside each of these sections 18 are two rollers 41 with their running surfaces 42 facing between which the sliding door 35 runs.

The drum 37 can house a means, not shown here, for storing energy against the action of which the sliding door is opened or closed.

What is claimed is:

1. In a freight container in particular for air transport comprising a supporting frame having a base frame, a pair of substantially parallel polygonal frames mounted on said base frame so as to define the long sides of the container, each of said polygonal frames comprising a pair of vertical opposed corner posts connected together by a roof section and a pair of vertical struts positioned between said base frame and said roof section such that the distance (a) between the vertical struts is equal to twice the distance (b) between a corner post and the closest vertical strut of said polygonal frame, a flat section connecting the respective roof sections of said pair of polygonal frames approximately midway between said corner posts and clamping means fixed to said flat section wherein the vertical struts of containers identical to said freight container when stacked are aligned and the clamping means on the flat sections of the lower of the identical containers secures the upper of the identical containers in place.

2. Freight container according to claim 1 wherein the roof sections house facilities for guiding a closure means.

3. Freight container according to claim 1 including a floor running parallel to the base frame, wherein the distance (a) is a function of the number of containers arranged next to or on top of each other, the height (h) of the corner post and the width (c) of the floor.

4. Freight container according to claim 1 including a floor running parallel to the base frame, wherein said base frame includes at least one cross member adjacent said floor having a groove provided therein defining a base member, a securing element engaging said groove and resting firmly on said base member.

5. Freight container according to claim 4 wherein said securing element is hammer-shaped and includes a shaft portion, wherein the cross member includes at least one recess communicating with said groove which creates shoulder-like ledges in which the shaft of the hammer-shaped securing element can be fitted while the hammer portion engages on the shoulder-like ledges.

6. Freight container according to claim 5 wherein the shaft is hinged by means of a pin introduced through a hole transverse to the axis (A) of the shaft.

7. Freight container according to claim 6 wherein said hole is elongated in the direction parallel the axis (A) and the securing element is moveable therein against the force created by a form of stored energy.

8. Freight container according to claim 1 wherein the roof sections are hollow in cross section.

9. Freight container according to claim 8 wherein said roof sections feature facing slits to accommodate a means of closure for the container.

10. Freight container according to claim 9 including struts joining the roof sections and corner members, wherein at least one of the corner posts, the struts joining the roof sections and the corner posts, and the roof sections feature hollow sections with facing slits on at least one of the transverse sides of the container, providing that the roof section, the struts joining the roof sections and the corner posts, and the corner posts join up with each other.

11. Freight container according to claim 10 including a sliding door which penetrates said slits.

12. Freight container according to claim 11 wherein the hollow sections house rollers with running surfaces between which the edge regions of the sliding door are led.

13. Freight container according to claim 12 wherein a drum for coiling up the sliding door is arranged between two facing vertical struts.

14. Freight container according to claim 13 wherein said drum includes a means of storing energy against the action of which the sliding door has to be opened or closed.

* * * * *